US010980702B2

(12) United States Patent
Moore

(10) Patent No.: US 10,980,702 B2
(45) Date of Patent: Apr. 20, 2021

(54) PORTABLE DEEP VEIN THROMBOSIS COMPRESSION DEVICE HAVING AN INTEGRATED PRESSURE CUFF AND UTILIZING A DISPOSABLE CUFF BARRIER

(71) Applicant: DJO, LLC, Vista, CA (US)

(72) Inventor: Michael Moore, Oceanside, CA (US)

(73) Assignee: DJO, LLC, Vista, CA (US)

( * ) Notice: Subject to any disclaimer, the term of this patent is extended or adjusted under 35 U.S.C. 154(b) by 240 days.

(21) Appl. No.: 16/027,674

(22) Filed: Jul. 5, 2018

(65) Prior Publication Data

US 2019/0008717 A1 Jan. 10, 2019

Related U.S. Application Data

(60) Provisional application No. 62/529,960, filed on Jul. 7, 2017.

(51) Int. Cl.
*A61H 9/00* (2006.01)
*A61H 1/00* (2006.01)

(52) U.S. Cl.
CPC ..... *A61H 9/0092* (2013.01); *A61H 1/00* (2013.01); *A61H 2201/0103* (2013.01); *A61H 2201/0157* (2013.01); *A61H 2201/1238* (2013.01); *A61H 2201/169* (2013.01); *A61H 2201/1654* (2013.01); *A61H 2201/1688* (2013.01);

(Continued)

(58) Field of Classification Search
CPC ..... A61H 2209/00; A61H 2201/0103; A61H 2201/1238; A61H 2201/1654; A61H 2201/169; A61H 2201/5025; A61H 2201/5043; A61H 2201/0192; A61H 2201/1635; A61H 2201/164; A61H 2201/1645; A61H 2201/165; A61H 2201/5061; A61H 2201/5097; A61H 2201/16; A61H 2205/062; A61H 2205/084; A61H 2205/106; A61H 2205/108; A61H 2205/12; A61H 2230/06; A61H 2230/30; A61H 2230/62; A61H 9/00; A61H 11/00; A61H 2011/005; A61H 31/00; A61B 5/00; A61B 17/132; A61B 5/02141; A61B 8/4227; A61F 5/00
USPC ..... 601/148–152, 88, 96, 105; 602/13; 606/202; 600/490–507
See application file for complete search history.

(56) References Cited

U.S. PATENT DOCUMENTS 4,548,249 A * 10/1985 Slaughterbeck ... A61B 5/02233 206/303
5,690,672 A * 11/1997 Cohen ..... A61B 5/02233 606/203

(Continued)

*Primary Examiner* — Valerie L Woodward
*Assistant Examiner* — Paige Kathleen Bugg
(74) *Attorney, Agent, or Firm* — Veros Legal Solutions, LLP

(57) ABSTRACT

A portable compression system for preventing deep vein thrombosis is provided. The portable compression system includes an inflatable apparatus comprising a monitor unit and at least one inflatable air cell. The portable compression system further includes an outer cuff comprising a pocket configured to receive the inflatable apparatus, the outer cuff configured to be wrapped around a portion of a patient's body where prevention of deep vein thrombosis is desired. The portable compression system further includes a disposable sleeve barrier configured to provide a physical barrier between the outer cuff and the portion of the patient's body.

17 Claims, 5 Drawing Sheets

(52) U.S. Cl.
CPC ..... *A61H 2201/5025* (2013.01); *A61H 2201/5043* (2013.01); *A61H 2209/00* (2013.01)

(56) References Cited

U.S. PATENT DOCUMENTS

| | | | | |
|---|---|---|---|---|
| 2005/0187503 | A1* | 8/2005 | Tordella | A61H 9/0078 602/13 |
| 2008/0262399 | A1* | 10/2008 | Kovelman | A61H 9/0078 601/152 |
| 2012/0065561 | A1* | 3/2012 | Ballas | A61H 9/0078 601/152 |
| 2013/0085427 | A1* | 4/2013 | Malhi | A61H 9/0092 601/148 |
| 2018/0199645 | A1* | 7/2018 | O'Connor | A45C 11/00 |
| 2019/0343711 | A1* | 11/2019 | Crossley | A61H 9/0078 |

* cited by examiner

PORTABLE DEEP VEIN THROMBOSIS COMPRESSION DEVICE HAVING AN INTEGRATED PRESSURE CUFF AND UTILIZING A DISPOSABLE CUFF BARRIER

CROSS-REFERENCE TO RELATED APPLICATIONS

This application claims the benefit of priority to U.S. Provisional Appl. No. 62/529,960, filed Jul. 7, 2017, which is incorporated in its entirety by reference herein.

BACKGROUND OF THE DISCLOSURE

Field of the Disclosure

The present application relates generally to pressure cuff systems and, more particularly, to portable deep vein thrombosis devices, integrated pressure cuffs, disposable cuff barriers, and configurations for the components thereof.

Description of the Related Technology

Deep vein thrombosis (DVT) occurs when a blood clot forms in one or more deep veins of the body, can cause pain and swelling, and can, in some circumstances, lead to life threatening conditions. DVT can occur in patients that have certain medical conditions that affect how their blood clots, or from sustained immobility, such as after surgery, following an accident, or anytime a patient is confined to a hospital or nursing home bed.

One treatment for DVT is to administer potent anticoagulants. Other treatments include the use of pneumatic compression devices, sometimes in conjunction with Aspirin administration, to prevent DVT formation. However, such pneumatic compression devices generally utilized in hospital settings are not portable and require the use of electrical cords for powering a compressor that provides pneumatic compression within the device, as well as tubes to provide compressed air from the compressor to a separate pressure cuff. Such electrical cords and/or tubes not only reduce the convenience of patient use, but also present serious tripping and tangling hazards to patients when they may be most vulnerable, such as after surgery or after an accident.

In addition, because of price pressure in the market, there is a trend toward using refurbished cuffs at a discounted price. However, where DVT pneumatic compression device manufacturers provide the device free of charge or at a substantially reduced price and sell the separate pressure cuffs, trends toward refurbished cuffs can substantially decrease or invert profit margins for device manufacturers and/or pressure cuff manufacturers.

For at least the above-mentioned reasons, a need exists for portable DVT devices having integrated pressure cuffs, disposable cuff barriers, and configurations for the components thereof.

SUMMARY

A portable compression system for preventing deep vein thrombosis is provided. The portable compression system includes an inflatable apparatus comprising a monitor unit and at least one inflatable air cell. The portable compression system further includes an outer cuff comprising a pocket configured to receive the inflatable apparatus. The outer is cuff configured to be wrapped around a portion of a patient's body where prevention of deep vein thrombosis is desired.

The portable compression system further includes a disposable sleeve barrier configured to provide a physical barrier between the outer cuff and the portion of the patient's body.

A method of utilizing a portable compression system configured to prevent deep vein thrombosis is provided. The method includes inserting an inflatable apparatus comprising a monitor unit and at least one inflatable air cell into a pocket of an outer cuff configured to receive the inflatable apparatus. The method further includes disposing a disposable sleeve barrier on the outer cuff, providing a sleeved outer cuff. The method further includes wrapping the sleeved outer cuff around the portion of the patient's body. The method further includes activating the monitor unit to provide a pressurized fluid to the at least one inflatable air cell thereby inflating the inflatable air cell, thereby providing a desired level of compression to the portion of the patient's body via the sleeved outer cuff.

A method for manufacturing a portable compression system for preventing deep vein thrombosis is provided. The method includes assembling an inflatable apparatus comprising a monitor unit and at least one inflatable air cell. The method further includes forming an outer cuff comprising a pocket configured to receive the inflatable apparatus. The outer cuff is configured to be wrapped around a portion of a patient's body where prevention of deep vein thrombosis is desired. The method further includes forming a disposable sleeve barrier configured to provide a physical barrier between the outer cuff and the portion of the patient's body during utilization of the portable compression system to prevent deep vein thrombosis.

DETAILED DESCRIPTION

The following detailed description and the appended figures are provided to describe and illustrate exemplary embodiments for the purpose of enabling one of ordinary skill in the relevant art. The description and figures are exemplary and not intended to limit the scope of the invention, or its protection, in any manner.

As used herein the term "attached" refers to the fixed, releasable, or integrated association of two or more elements, components, and/or devices. The term "attached" includes releasably attaching or fixedly attaching two or more elements, components, and/or devices. The singular forms "a," "an," and "the" include plural referents unless the context clearly dictates otherwise.

Figure 1:
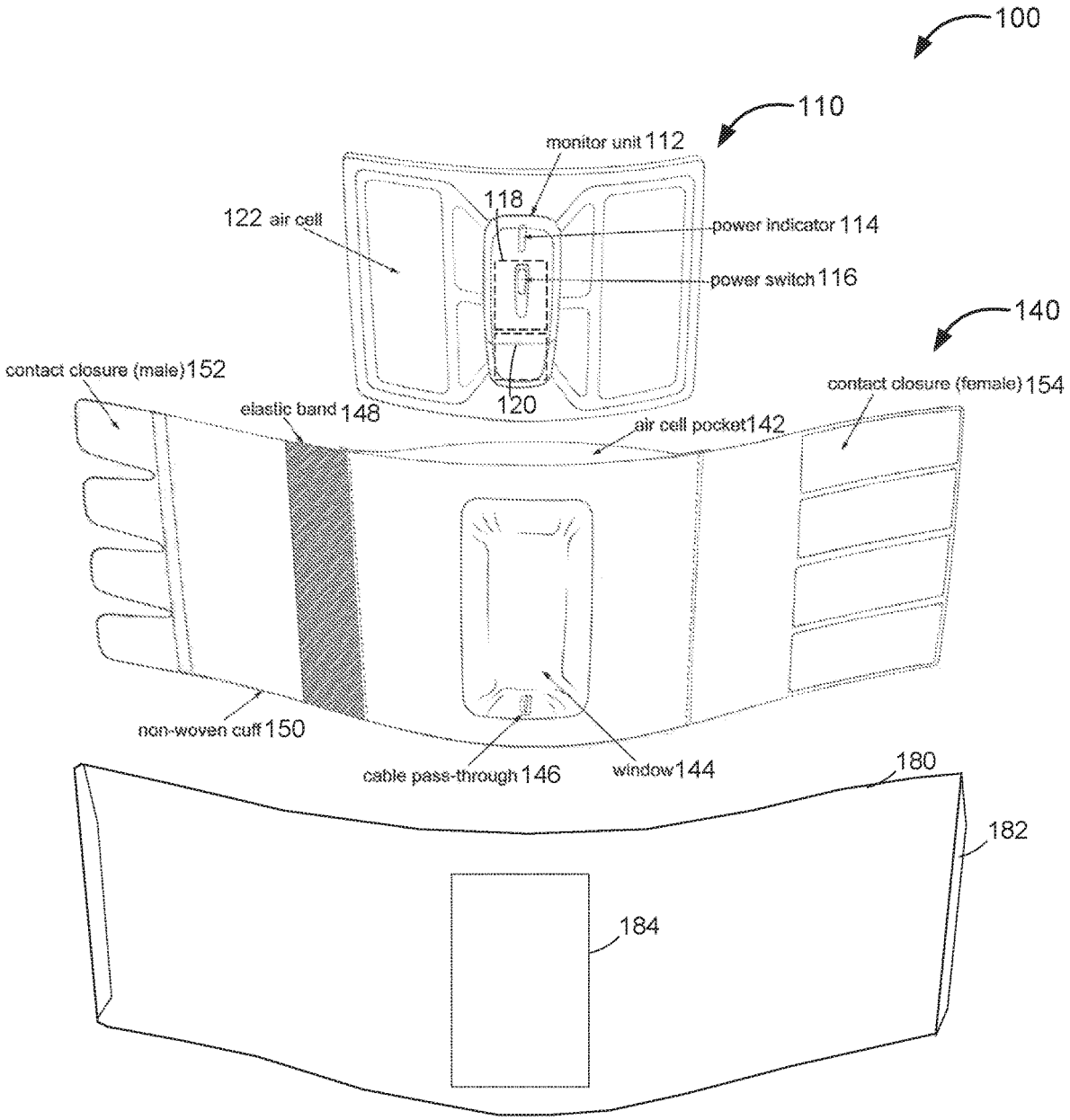
FIG. 1 provides a view of a portable pneumatic DVT compression device including an inflatable apparatus having a monitor unit and at least one inflatable air cell, an outer cuff, and a disposable sleeve barrier, in accordance with some embodiments.

FIG. 1 provides a view 100 of a portable pneumatic DVT compression device 100 including an inflatable apparatus 100 having a monitor unit 112 and at least one inflatable air cell 122, an outer cuff 140, and a disposable sleeve barrier 180, in accordance with some embodiments.

In some embodiments, the monitor unit 112 further comprises one or more of a power indicator 114, a power switch 116, a pump 118, and a battery 120. In some embodiments, power indicator 114 is configured to indicate when monitor unit 112 is in operation, e.g., the ON/OFF state of monitor unit 112. In some embodiments, power indicator 114 may be mechanical, e.g., a colored tab that is exposed when the monitor unit 112 is in operation, or alternatively electronic, e.g., an indicator that is illuminated when the monitor unit 112 is in operation. In some other embodiments, power indicator 114 may be a part of a larger display (not shown in FIG. 1) configured to display at least one of compliance data and use data corresponding to the compression system. For example, compliance data may include data indicating the level of compliance with known or prescribed DVT prevention regiments that the compression system 100 has operated under, has already complied with, or has yet to comply with for one or more particular patient(s). Use data may correspond to any data indicating or logging past usage and/or the characteristics of that usage for one or more patients (e.g., compression level, time under compression, number of cycles under compression, number of patients treated or uses of the device). In one embodiment, the compression device comprises an outer sleeve, which can function as both a barrier and an anti-migration wrap. Advantageously, the inner pump unit is configured to fit into the outer sleeve. In some other embodiments, the display and power indicator 114 may be separate components.

In some embodiments, power switch 116 is configured to turn monitor unit 112 ON and/or OFF. Power switch 116 may comprise a push-button, a switch, or any other structure configured to turn monitor 112 and/or pump 118 ON and/or OFF.

In some embodiments, pump 118 may be pneumatic, e.g., configured to provide a pressurized fluid to the at least one inflatable air cell 122. In some embodiments, the pressurized fluid comprises a gas, e.g., air, or alternatively a liquid, e.g., water. In some embodiments, pump 118 may be configured to provide the pressurized fluid at a pressure of 45-50 millimeters of Mercury (mmHg), although any other desired pressure range is also contemplated. In some embodiments, pump 118 may be configured to provide such a desired pressure range relatively slowly, for example, taking 5 seconds to achieve the desired level of compression upon activation and under regulation by monitor unit 112. In addition, in some embodiments, pump 118 may operate relatively quietly, for example, operating at a sound level of 45 decibels or less. Such quiet operation provides an environment to facilitate sleep and/or rest. To ensure durability, the at least one inflatable air cell 122 may comprise a cryo-cuff material or any other suitable material providing sufficient longevity to be utilized on multiple patients, daily for at least one year, for example, polyurethane, PVC, or a blend of the same.

In some embodiments, battery 120 may be configured to provide power to at least pump 118 and monitor unit 112. In some embodiments, battery 120 may have an energy capacity sufficient to continuously power compression device 100 for at least 8 hours. In some embodiments, battery 120 may be rechargeable. In other embodiments, battery 120 may not be chargeable and may instead be easily replaceable.

Monitor unit 112 may be configured to control the operation of compression device 100 and may monitor the pressure and/or level of inflation of the at least one air cell 122 to ensure compliance with an intended DVT prevention protocol and/or to prevent tissue injury, for example, caused by tourniquetting of the treated portion of the patient's body. For example, monitor unit 112 may control pump 118 thereby inflating the inflatable air cell and providing a desired level of compression to a portion of the patient's body when inflatable apparatus 110 is disposed in a pocket 142 of outer cuff 140. In some embodiments, monitor 112 may be configured to hold a desired level of compression for a predetermined and/or selectable interval of time. In some embodiments, monitor unit 112 is configured to provide protection against tourniquet, for example, by ensuring the compression provided by the at least one air cell 122 does not exceed a particular peak threshold, or does not exceed a particular average threshold for a predetermined interval of time. In some embodiments, monitor unit 112 may provide for a relatively slow inflation of air cell 122 to a desired target pressure and/or compression, e.g., 5 seconds.

Outer cuff 140 is configured to be wrapped around a portion of a patient's body where prevention of DVT is desired, e.g., a calf, arm, upper leg, etc. Outer cuff 140 comprises an air cell pocket 142 configured to receive inflatable apparatus 110, a relatively inelastic portion 150, at least one elastic portion 148 configured to stretch when outer cuff 140 is wrapped around the desired portion of a patient's body, and at least one securing mechanism (e.g., 152, 154) configure to secure outer cuff 140 around the portion of the patient's body. As shown in FIG. 1, the at least one securing mechanism may comprise a first portion 152 disposed at a first end of outer cuff 140 and configured to couple to a second portion 154 of the at least one securing mechanism disposed at a second end of outer cuff 140, thereby securing outer cuff 140 around the portion of the patient's body for which DVT prevention is desired. In some embodiments, outer cuff 140 may comprise an anti-migration mechanism, for example, a patch of high friction material that prevents outer cuff 140 from creeping or moving from an initial desired position or alignment during operation.

In some embodiments, pocket 142 of outer cuff 140 further comprises a window 144 configured to provide visibility of monitor unit 112 when inflatable apparatus 110 is disposed in pocket 142 of outer cuff 140. In some embodiments, window 144 and/or pocket 142 further comprises an aperture 146 configured to allow a power cable (not shown in FIG. 1) to pass through. In such embodiments, monitor unit 112 may be configured to receive charging power from such a power cable for powering compression system 100 or for recharging battery 120. By virtue of at least the integrated nature of air cell 122 and monitor unit 112 within inflatable apparatus 110, inclusion of battery 120 within monitor unit 120, and the disposability of inflatable apparatus 110 in pocket 142 of outer cuff 140, compression system 100 is truly portable, does not require a corded connection for operation, and does not include lengthy pneumatic tubes for connecting a pressure cuff to a disparate pump and/or control station. Such advantages provide tangible benefits for both hospitals offering care to patients and to those patients themselves.

Disposable sleeve barrier 180 is configured to provide a physical barrier between outer cuff 140 and the portion of the patient's body around which outer cuff 140 is wrapped. Whereas outer cuff 140 and inflatable apparatus 110 are configured to be reusable, for example being manufactured to provide at least one year of daily operation for multiple patients, disposable sleeve barrier 180 is configured to be a single-use sleeve for discarding and replacement after each use. As such, disposable sleeve barrier 180 may comprise at least one of paper, plastic, or fabric. In some embodiments, disposable sleeve barrier 180 may simply comprise a sheet of disposable material configured to be placed between the outer cuff 140 and the patient's body. In some other embodiments, disposable sleeve barrier 180 may comprise an actual sleeve having an opening 182 disposed on at least one end such that disposable sleeve barrier 180 is configured to slip over outer cuff 140 like a sheath or garment and provide a disposable barrier substantially around outer cuff 140. In some such embodiments, disposable sleeve barrier 180 may comprise a window or cutout 184 configured to provide visibility of monitor unit 112 when inflatable apparatus 110 is disposed in pocket 142 of outer cuff 140. In other such embodiments, disposable sleeve barrier 180 may not comprise window or cutout 184. The disposable nature of disposable sleeve barrier 180 additionally provides the benefit of being "green", e.g., eco-friendly.

Thus, the portable, lightweight nature of compression system 100, as previously described, as well as the low cost associated with utilizing disposable sleeve barriers 180 in conjunction with outer cuff 140 and inflatable apparatus 110 provide a DVT prevention solution that is less expensive, less cumbersome, and more portable than current non-portable solutions not offering disposable sleeve barriers available to hospitals.

Figure 2:
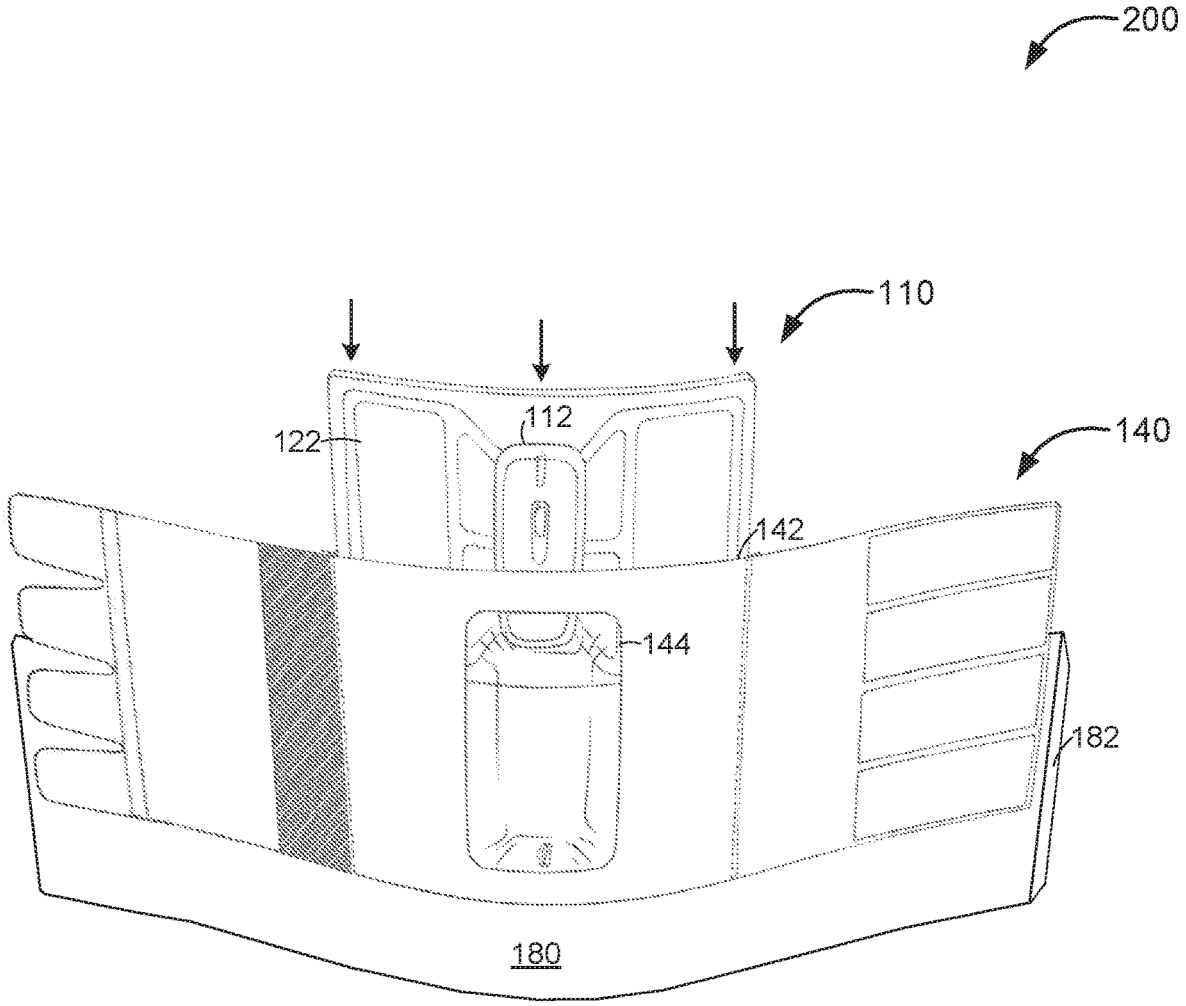
FIG. 2 provides a view of the portable pneumatic DVT compression device of FIG. 1, where the inflatable apparatus is partially inserted into the outer cuff, in accordance with some embodiments.

FIG. 2 provides a view 200 of portable pneumatic DVT compression device 100 of FIG. 1, where inflatable apparatus 110 is partially inserted into outer cuff 140, in accordance with some embodiments. As shown by the arrows, inflatable apparatus 110, comprising inflatable air cell 122 and monitor unit 112, is configured to be inserted into pocket 142 of outer cuff 140. Window 144 of pocket 142 is shown as providing visibility of monitor unit 112 when inserted into pocket 142. Disposable sleeve barrier 180 is shown behind outer cuff 140.

Figure 3:
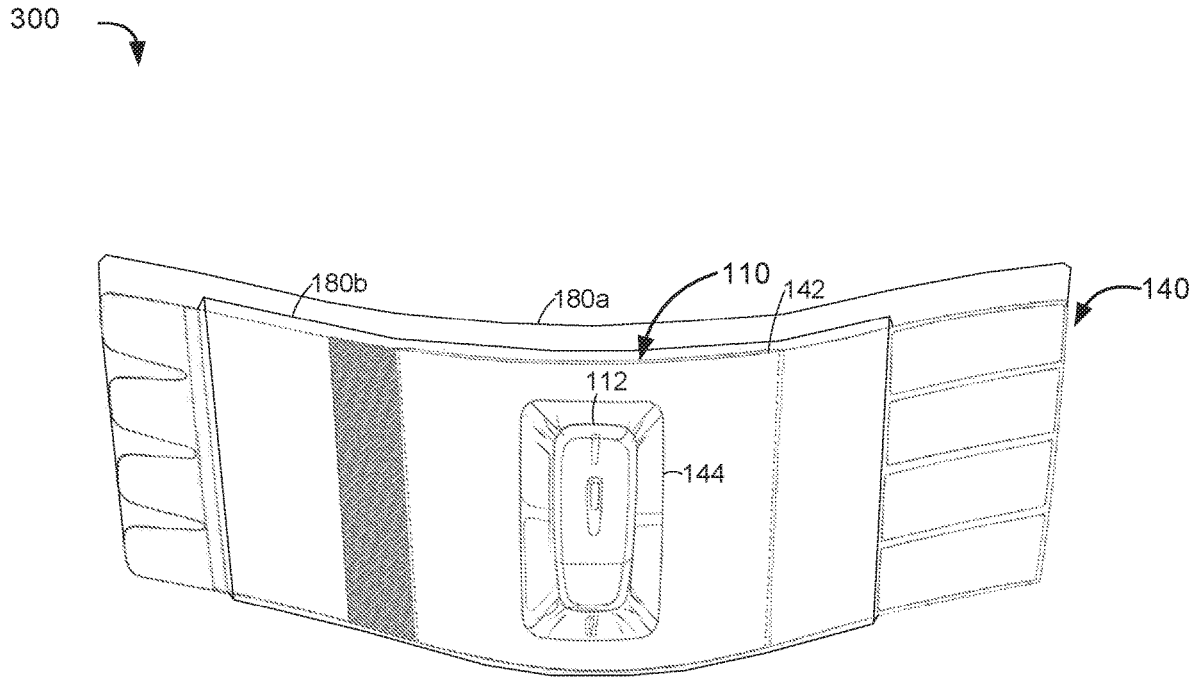
FIG. 3 provides a view of the portable pneumatic DVT compression device of FIG. 1 with the inflatable apparatus fully inserted into the outer cuff and the outer cuff inserted in the disposable sleeve barrier, in accordance with some embodiments.

FIG. 3 provides a view 300 of portable pneumatic DVT compression device 100 of FIG. 1 with inflatable apparatus 110 fully inserted into outer cuff 140 and outer cuff 140 inserted in disposable sleeve barrier 180, in accordance with some embodiments. Inflatable apparatus 110 is full inserted in pocket 142 of outer cuff 140. Window 144 provides a view of monitor unit 112 of inflatable apparatus 110 once inflatable apparatus 110 is fully inserted in pocket 142. FIG. 3 simultaneously illustrates two embodiments of disposable sleeve barrier 180 as previously described in connection with FIGS. 1 and 2. In a first embodiment, disposable sleeve barrier 180 of FIGS. 1 and 2 is shown as disposable sleeve barrier 180*a*, a sheet of disposable material to be disposed between the patient's body and outer cuff 140. In a second embodiment, disposable sleeve barrier 180 of FIGS. 1 and 2 is shown as disposable sleeve barrier 180*b*, a sleeve of disposable material into which outer cuff 140 is configured to be inserted, and which is configured to substantially surround outer cuff 140. In the second embodiment shown, disposable sleeve barrier 180*b* does not cover first portion 152 and second portion 154 of securing mechanism of outer cuff 140. However, in other embodiments, disposable sleeve barrier 180*b* may cover a portion of all of first portion 152 and second portion 154 of securing mechanism of outer cuff 140.

Figure 4:
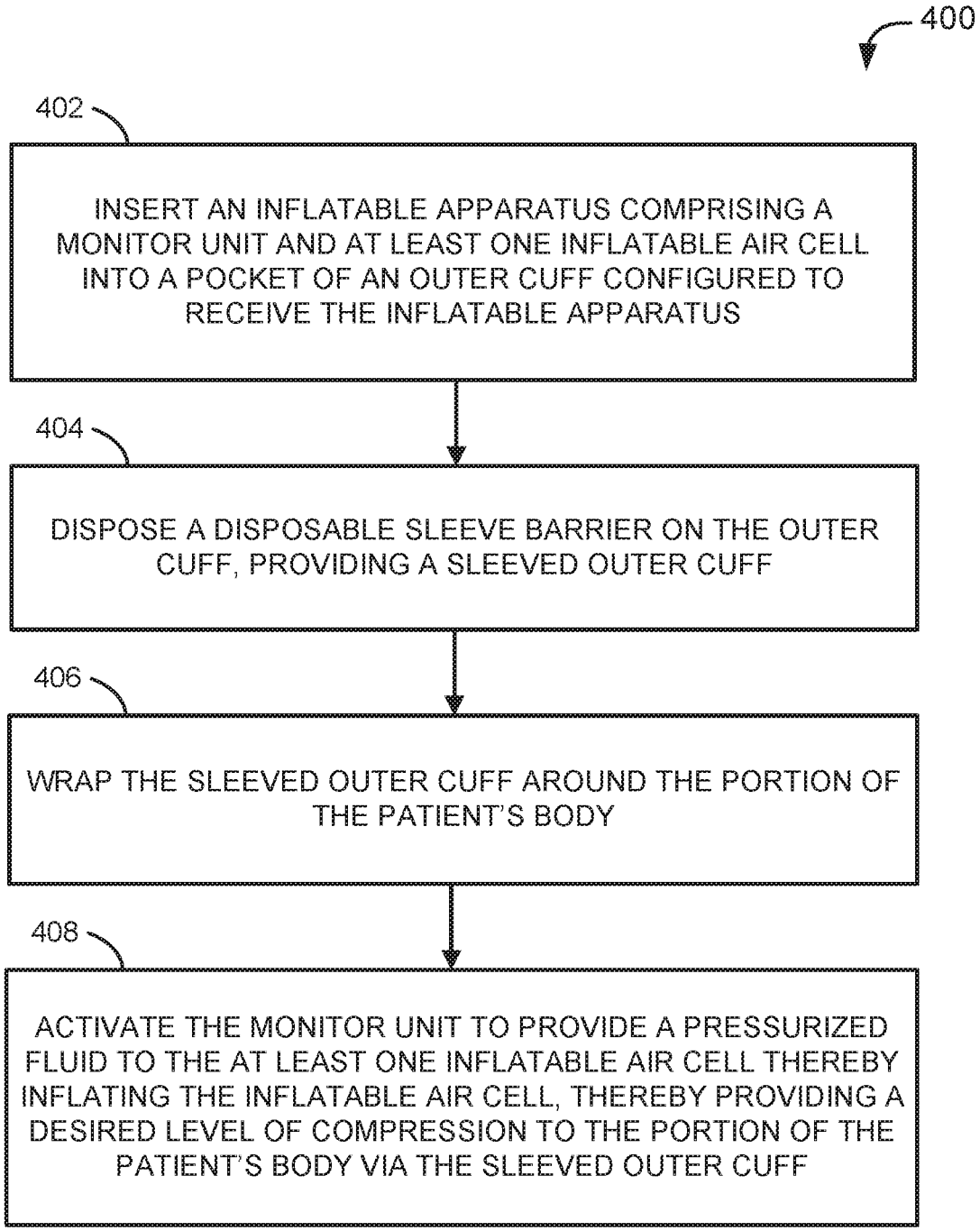
FIG. 4 illustrates a flowchart for a method of utilizing the portable pneumatic DVT compression device of FIG. 1, in accordance with some embodiments.

FIG. 4 illustrates a flowchart 400 for a method of utilizing the portable pneumatic DVT compression device 100 of FIG. 1, in accordance with some embodiments. Although blocks, steps or actions are shown in a particular order, the present application is not so limited and more or fewer actions in the same or different order than those described are also contemplated.

Flowchart 400 includes block 402, which recites inserting an inflatable apparatus comprising a monitor unit and at least one inflatable air cell into a pocket of an outer cuff configured to receive the inflatable apparatus. For example, a patient or health care professional may insert inflatable apparatus 110 comprising monitor unit 112 and at least one inflatable air cell 122 into pocket 142 of outer cuff 140 configured to receive inflatable apparatus 110.

Flowchart 400 includes block 404, which recites disposing a disposable sleeve barrier on the outer cuff, providing a sleeved outer cuff. For example, a patient or health care professional may dispose disposable sleeve barrier 180 on outer cuff 140, providing a sleeved outer cuff.

Flowchart 400 includes block 406, which recites wrapping the sleeved outer cuff around the portion of the patient's body. For example, a patient or health care professional may wrap the sleeved outer cuff 140+180 around the portion of the patient's body. In some embodiments, flowchart 400 further includes securing outer cuff 140 around the portion of the patient's body utilizing at least one securing mechanism 152, 154 of outer cuff 140.

Flowchart 400 includes block 408, which recites activating the monitor unit to provide a pressurized fluid to the at least one inflatable air cell thereby inflating the inflatable air cell, thereby providing a desired level of compression to the portion of the patient's body via the sleeved outer cuff. For example, the patient or health care professional may activate monitor unit 112 to provide a pressurized fluid to the inflatable air cell 122 thereby inflating inflatable air cell 122, thereby providing a desired level of compression to the portion of the patient's body via sleeved outer cuff 140+180. In some embodiments, activating monitor unit 112 comprises activating power switch 116 of monitor unit 112.

In some embodiments, flowchart 400 may additionally include viewing at least one of compliance data and data corresponding to the compression system on a display of the monitor unit. In some embodiments, flowchart 400 may additionally include connecting a power cable to the monitor unit through an aperture in a window of the pocket of the outer cuff thereby providing the monitor unit with charging power from the power cable.

Figure 5:
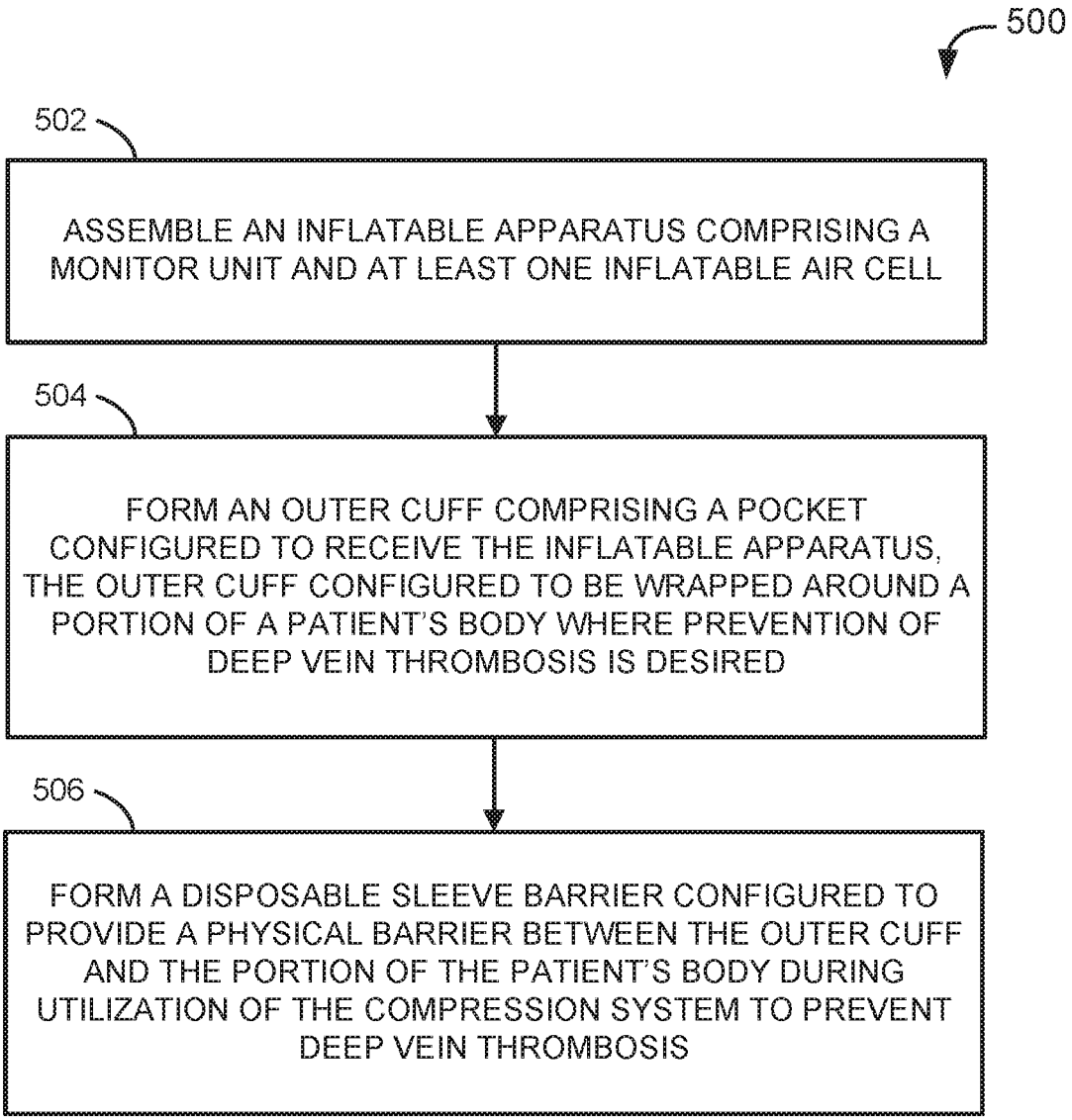
FIG. 5 illustrates a flowchart for a method of manufacturing the portable pneumatic DVT compression device of FIG. 1, in accordance with some embodiments.

FIG. 5 illustrates a flowchart 500 for a method of manufacturing portable pneumatic DVT compression device 100 of FIG. 1, in accordance with some embodiments. Although blocks, steps or actions are shown in a particular order, the present application is not so limited and more or fewer actions in the same or different order than those described are also contemplated.

Flowchart 500 includes block 502, which recites assembling an inflatable apparatus comprising a monitor unit and at least one inflatable air cell. For example, inflatable apparatus 110 comprising monitor unit 112 and at least one inflatable air cell 122 may be assembled.

Flowchart 500 includes block 504, which recites forming an outer cuff comprising a pocket configured to receive the inflatable apparatus, the outer cuff configured to be wrapped around a portion of a patient's body where prevention of deep vein thrombosis is desired. For example, outer cuff 140 comprising pocket 142 configured to receive inflatable apparatus 110 may be formed. Outer cuff 140 is configured to be wrapped around a portion of a patient's body where prevention of deep vein thrombosis is desired.

Flowchart 500 includes block 506, which recites forming a disposable sleeve barrier configured to provide a physical barrier between the outer cuff and the portion of the patient's body during utilization of the compression system to prevent deep vein thrombosis. For example, disposable sleeve barrier 180, configured to provide a physical barrier between outer cuff 140 and the portion of the patient's body during utilization of compression system 100 to prevent deep vein thrombosis, may be formed.

The foregoing disclosure includes the best mode for practicing the claimed invention(s). It is apparent, however, that those skilled in the relevant art will recognize variations that are not described herein. While the application includes the appended claims, the present disclosure is not limited to the literal meaning of the claims, but also includes these variations.

What is claimed is:

1. A portable compression system for preventing deep vein thrombosis, the system comprising:

an inflatable apparatus comprising a monitor unit and at least one inflatable air cell;

an outer cuff configured to be wrapped around a portion of a patient's body where prevention of deep vein thrombosis is desired, the outer cuff comprising:

a pocket configured to receive the inflatable apparatus, and a securing mechanism comprising a first portion disposed at a first end of the outer cuff and configured to couple to a second portion disposed at a second end of the outer cuff, thereby securing the outer cuff around the portion of the patient's body; and a disposable sleeve barrier configured to surround a front, a back, a top, and a bottom of the outer cuff and thereby provide a physical barrier between the outer cuff and the portion of the patient's body, wherein the first and second portions of the securing mechanism of the outer cuff extend laterally beyond at least one side of the disposable sleeve barrier when the outer cuff is properly disposed within the disposable sleeve barrier, thereby allowing the first portion to couple to the second portion when the outer cuff and the disposable sleeve barrier are wrapped around the portion of the patient's body.

2. The portable compression system of claim 1, wherein the monitor unit further comprises a pump configured to provide a pressurized fluid to the at least one inflatable air cell thereby inflating the inflatable air cell and providing a desired level of compression to the portion of the patient's body when the inflatable apparatus is disposed in the pocket of the outer cuff.

3. The portable compression system of claim 2, wherein the pressurized fluid comprises a gas.

4. The portable compression system of claim 1, wherein the monitor unit further comprises a power indicator configured to indicate when the monitor unit is in operation.

5. The portable compression system of claim 1, wherein the monitor unit further comprises a power switch configured to turn the monitor unit on and off.

6. The portable compression system of claim 1, wherein the monitor unit further comprises a display configured to display at least one of compliance data and use data corresponding to the portable compression system.

7. The portable compression system of claim 1, wherein the pocket of the outer cuff further comprises a window configured to provide visibility of the monitor unit when the inflatable apparatus is disposed in the pocket of the outer cuff.

8. The portable compression system of claim 7, wherein the window further comprises an aperture configured to allow a power cable to pass through and wherein the monitor unit is further configured to receive charging power from the power cable.

9. The portable compression system of claim 1, wherein the outer cuff further comprises at least one elastic portion configured to stretch when the outer cuff is wrapped around the portion of the patient's body.

10. The portable compression system of claim 1, wherein the disposable sleeve barrier is configured to slip over the outer cuff and comprises at least one of paper, plastic, or fabric.

11. A method of utilizing a portable compression system configured to prevent deep vein thrombosis, the method comprising:

inserting an inflatable apparatus comprising a monitor unit and at least one inflatable air cell into a pocket of an outer cuff configured to receive the inflatable apparatus, the outer cuff further comprising a securing mechanism comprising a first portion disposed at a first end of the outer cuff and a second portion disposed at a second end of the outer cuff;

surrounding a front, a back, a top, and a bottom of the outer cuff with a disposable sleeve barrier to provide a sleeved outer cuff, wherein the first and second portions of the securing mechanism of the outer cuff extend laterally beyond at least one side of the disposable sleeve barrier when the outer cuff is properly disposed within the disposable sleeve barrier;

wrapping the sleeved outer cuff around a portion of a patient's body such that the first portion of the securing mechanism of the outer cuff couples to the second portion of the securing mechanism of the outer cuff and such that the disposable sleeve barrier provides a physical barrier between the outer cuff and the portion of the patient's body; and activating the monitor unit to provide a pressurized fluid to the at least one inflatable air cell thereby inflating the inflatable air cell, thereby providing a desired level of compression to the portion of the patient's body via the sleeved outer cuff.

12. The method of claim 11, wherein the pressurized fluid comprises a gas.

13. The method of claim 11, wherein activating the monitor unit comprises activating a power switch of the monitor unit.

14. The method of claim 11, further comprising viewing at least one of compliance data and data corresponding to the portable compression system on a display of the monitor unit.

15. The method of claim 11, further comprising connecting a power cable to the monitor unit through an aperture in a window of the pocket of the outer cuff thereby providing the monitor unit with charging power from the power cable.

16. The method of claim 11, wherein the disposable sleeve barrier comprises at least one of paper, plastic, or fabric.

17. A method for manufacturing a portable compression system for preventing deep vein thrombosis, the method comprising:

assembling an inflatable apparatus comprising a monitor unit and at least one inflatable air cell;

forming an outer cuff configured to be wrapped around a portion of a patient's body where prevention of deep vein thrombosis is desired, the outer cuff comprising:

a pocket configured to receive the inflatable apparatus, and a securing mechanism comprising a first portion disposed at a first end of the outer cuff and configured to couple to a second portion disposed at a second end of the outer cuff, thereby securing the outer cuff around the portion of the patient's body; and forming a disposable sleeve barrier configured to surround a front, a back, a top, and a bottom of the outer cuff and thereby provide a physical barrier between the outer cuff and the portion of the patient's body during utilization of the portable compression system to prevent deep vein thrombosis, wherein the first and second portions of the securing mechanism of the outer cuff extends laterally beyond at least one side of the disposable sleeve barrier when the outer cuff is properly disposed within the disposable sleeve barrier, thereby allowing the first portion to couple to the second portion when the outer cuff and the disposable sleeve barrier are wrapped around the portion of the patient's body.

* * * * *